United States Patent [19]

Stephens et al.

[11] 4,317,392

[45] Mar. 2, 1982

[54] RATCHET WRENCH

[75] Inventors: Leonard W. Stephens, Fairview; Mack Salladay, Morgan, both of Pa.

[73] Assignee: Perry M. Lane, Washington, Pa.

[21] Appl. No.: 249,061

[22] Filed: Mar. 30, 1981

[51] Int. Cl.[3] ..... B25B 13/46

[52] U.S. Cl. ..... 81/63.1; 81/177 G

[58] Field of Search ..... 81/60–63.2, 81/177 G

[56] References Cited

U.S. PATENT DOCUMENTS

| | | | |
|---|---|---|---|
| 3,777,596 | 12/1973 | Smyers | 81/177 G |
| 4,187,747 | 2/1980 | Pawlow | 81/177 G |
| 4,245,528 | 1/1981 | Hugh et al. | 81/177 G |

*Primary Examiner*—James L. Jones, Jr.
*Attorney, Agent, or Firm*—Ralph Hammar

[57] ABSTRACT

A ratchet wrench with an improved socket releasing mechanism.

11 Claims, 3 Drawing Figures

RATCHET WRENCH

Figure 1:
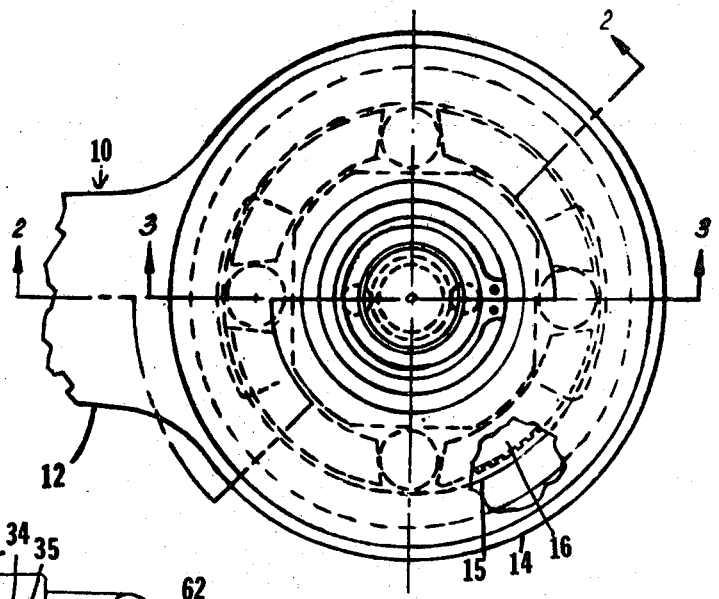

This invention improves the mechanism for quickly releasing a socket. It is disclosed as applied to the wrench of application Ser. No. 149,462, filed May 13, 1980, incorporated by reference.

Figure 2:
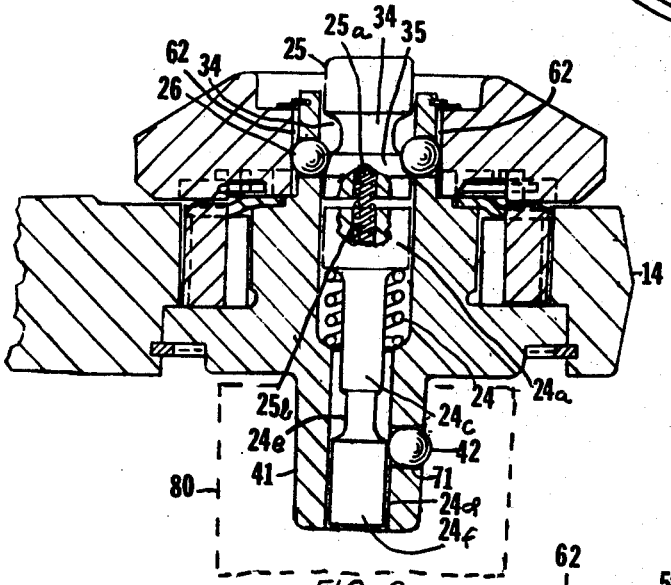
Figure 3:
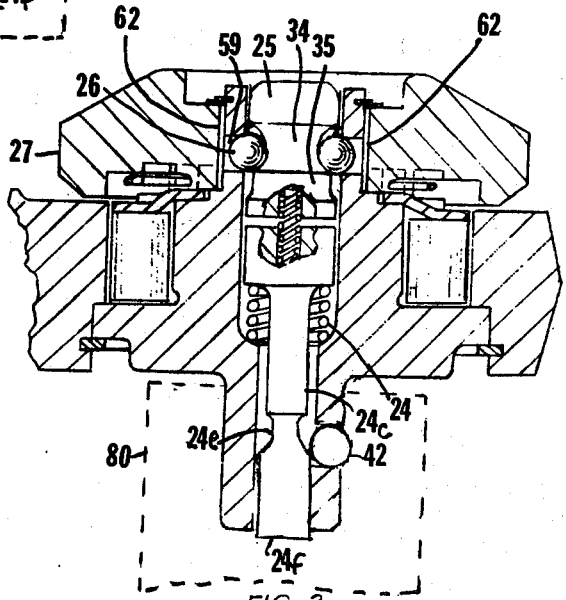

In the drawing,

FIG. 1 is a top view of a preferred embodiment of the invention showing the wrench with the drive in neutral, FIG. 2 is a cross-sectional view taken on line 2—2 in FIG. 1 but with the cap of the wrench turned to latch the drive in a driving position, and FIG. 3 is a cross-sectional view taken on line 3—3 in FIG. 1.

As described in greater detail in application Ser. No. 149,462, the wrench 10 has a handle 12 with a body 14 at one end provided with an internal cylindrical surface 15 which can be engaged by the outer cylindrical surfaces of clutch shoes 16. In FIGS. 1 and 3, the clutch shoes are out of engagement with the cylindrical surface 15. In this position, locking balls 26 are received in a peripheral recess 34 in pushbutton 25 and socket locking ball 42 is cammed outward by head **24*f* in the lower end of pin 24*c* slidable in bore 24*d*. A spring 24 surrounding the pin 24*c* engages the underside of the enlarged head 24*a* at the upper end of the pin and urges it upward. The force from spring 24 is transmitted to pushbutton 25 through spring 25*a* having its lower end seated in socket 25*b* in head 24*a* and its upper end seated in socket 25*c* in the lower end of the pushbutton. The springs 24 and 25*a* act in opposition on the pin 24*c*, the spring 25*a* pushes downward and the spring 24** pushes upward.

In FIG. 3, the button 25 is in a lower position than in FIG. 2, and the pin **24*c* is moved correspondingly lower, but there remains some outward force exerted by the head 24*f* on the ball 42, a force which is not large enough to prevent mounting a socket on the drive member 41 and which may be sufficient to lock the socket on the drive member. In the FIG. 3 position, there is sufficient clearance in the peripheral recess 34 above the balls 26 to permit pushing the pushbutton 25 still lower to move the head 24*f* of the pin 24*c* completely below the ball 42 and to allow the ball to move into the groove 24*e* in the pin and to be fully retracted within the opening 71**.

To go from the neutral position of FIG. 3 to the driving position of FIG. 2, the cap 27 is turned in the direction in which the drive is to be established. For driving counterclockwise, the cap would be turned in a counterclockwise direction. The turning of the cap from the neutral position stresses a centering spring (not shown), storing a force which will return the cap to neutral when the drive is subsequently released. When the balls 26 come opposite diametrically opposed grooves 62 in the bore 59 of the cap, the balls move outward into the grooves and the pushbutton 25 moves upward, bringing the relatively shallow groove 35 in the pushbutton opposite the balls. The drive is now latched in the driving position. In the driving position, the clutch shoes 16 are cammed outward into gripping engagement with the surfaces 15 when the body 14 is rotated in the driving direction, and the gripping engagement of the shoes is released when the body is rotated in the reverse direction, thereby producing a unidirectional drive.

To change to a new driving direction or to change sockets, the pushbutton 25 is first pushed downward. When the peripheral groove 34 is the pushbutton comes opposite the balls 26, the balls move into the groove and the centering spring returns the cap 27 to the neutral position where the balls 26 are between pairs of grooves 62 and are held in the peripheral groove 34 by engagement with the bore 59 of the cap. To change sockets, the pushbutton 25 is still further depressed, this movement being permitted by the space between the balls 26 and the upper side of the groove 34, thereby moving the locking pin **24*c* downward until the head 24*f* is clear of the socket locking ball 42. This allows the socket locking ball to be completely received within the opening 71 and, in the absence of the restraining force of the ball, the socket drops off the drive member 41. When downward pressure on the pushbutton is released, pin 24*c* moves upward to the position shown in FIG. 3, where the socket locking ball 42** is cammed outward.

To reestablish the drive, the cap 27 is turned in the driving direction through an angle of about 45° so that the balls 26 can move outward into the axial grooves 62 in the cap. There are two sets of axial grooves 62 ninety degrees from each other so that the average rotation of the cap from neutral to a driving position is about 45°.

In the driving position of FIG. 2, a socket 80 is locked on the drive member 41 by ball 42 which is moved outward by the head **24*f* at the lower end of pin 24*c*. The head 24*f* is moved upward past the center of the ball 42 so that inward movement of the ball 42** is positively blocked and the socket is locked on the drive member.

Although the release of the socket is controlled by the same pushbutton 25 that releases the drive to the socket, the drive and socket release are independent of each other. If the wrench is used with a socket which has no recess for the locking ball 42, then the locking ball 42 cannot move outward as shown in FIG. 2, but merely moves into friction gripping engagement with the socket. With this type of socket, the pin **24*c* would be lower than illustrated, so that the ball could be fully retracted within the opening 71. Under these conditions, the pushbutton 25 and cap 27 control the drive in the same manner as described above. It is not essential that the pin 24*c* move upward to the position shown in FIG. 2 for the drive to be established. The drive is independent of the socket locking pin. The drive depends on the position of the pushbutton. The spring 25*a* exerts a sufficient upward pressure on the button 25 to move the button from the FIG. 3 to the FIG. 2** position.

The drive can be returned to neutral by pushing the button 25 until the shallow peripheral groove 34 comes opposite the ball 26, as shown in FIG. 3. The FIG. 3 position can be a storage position for the wrench.

When the wrench is to be used, the proper size socket 80 is mounted on the drive member 41 and the cap 27 turned in the direction in which the drive is to be established. All this is entirely independent of the position of the pin **24*c*** which controls the locking of the socket on the drive member.

We claim:

1. A ratchet wrench or the like having a rotatable body, a drive member in the body, means for driving the drive member in either clockwise or counterclockwise directions, a pushbutton for releasing the drive and returning the driving means to neutral, a cap rotatable relative to the drive member for establishing the drive in either the clockwise or counterclockwise direction, a longitudinal passage in the drive member, a longitudinally movable pin in said passage, an aperture in said drive member communicating with said passage, a detent element mounted in said aperture, means for limiting outward movement of the detent in said aperture, the detent being normally engaged with a surface of said pin and held thereby in outwardly located position in order to engage and hold the socket on the drive member, a recess in said pin for selective alignment with said detent element so that the latter is received therein for releasing the socket, a first spring normally urging the pin to a position where it holds the detent outwardly, said pin extending toward said pushbutton, another spring between said pushbutton and said pin for transmitting a force from said pushbutton to said pin to overcome said first spring and release the socket.

2. The wrench of claim 1 in which the cap is latched in the driving position and is spring biased to neutral.

3. The wrench of claim 2 in which the pushbutton releases the latch.

4. The wrench of claim 3 in which the latch is released by an initial movement of the pushbutton and the socket is released by a further movement of the pushbutton.

5. The wrench of claim 3 in which the latch is released by an initial force on the pushbutton and the socket is released by a force on the pushbutton larger than said initial force.

6. The wrench of claim 1 in which the means for driving the drive member is further defined as an inner annular surface on the body, arcuate shoes located between the drive member and said inner surface for frictionally engaging said inner surface, rollers located between the arcuate shoes and engageable with the ends of the shoes to press them against said inner surface, a rigid positioning member movable in one direction to engage the shoes and hold first ends of the shoes against the rollers and the rollers against the drive member whereby when the body is rotated in said one direction the shoes are held by the rollers against said inner surface and the rollers engaging the drive member force the drive member to rotate in said one direction, but when the body is rotated in the opposite direction the shoes can slide on said inner surface, the rigid positioning member being movable in said opposite direction to engage the shoes and hold second ends of the shoes against the rollers and the rollers against the drive member whereby when the body is rotated in said opposite direction the shoes are held by the rollers against said inner surface and the rollers engaging the drive member force the drive member to rotate in said opposite direction, but when the body is rotated in said one direction the shoes can slide on said inner surface, and actuating means having spring means engageable with the rigid positioning member to press it to its shoe engaging positions.

7. The wrench of claim 1 in which the means for driving the drive member is further defined as an inner annular surface on the body, shoes having outer surfaces for frictionally engaging said annular surface, rollers engageable with the ends of said shoes, a drive member having cam means engageable with said rollers, reversing means comprising a rigid positioning member movable in one direction to engage the shoes and press first ends of the shoes against the rollers and the rollers against the cam means of the drive member so that when said drive means rotates the body member in said one direction the shoes are held by the rollers in engagement with the body member, forcing the shoes and drive member to rotate, whereas when said drive means rotates the body member in the opposite direction the shoes are not so held, said rigid positioning member being movable in said opposite direction to engage the shoes and press second ends of the shoes against the rollers and the rollers against the cam means of the drive member so that when said drive means rotates the body member in said opposite direction the shoes are held by the rollers in engagement with the body member forcing the shoes and drive member to rotate, whereas when said drive means rotates the body member in said one direction the shoes are not so held, and actuating means having spring means engageable with the rigid positioning member to move it to its shoe engaging positions.

8. The wrench recited in claim 7 wherein the rigid positioning member comprises a wheel having portions that overlie said rollers and that are engageable with the shoes.

9. The wrench recited in claim 8 wherein the spring means comprises a ring-shaped spring having a first and a second end, the cap being engageable with said first end to press said second end against the rigid positioning member and move the latter in said one direction, the cap being engageable with said second end to press said first end against the rigid positioning member and move the latter in said opposite direction, and including means for fixing the cap relative to the shank in a first setting with the rigid positioning member moved in said one direction, and in a second setting with the rigid positioning member moved in said opposite direction.

10. The wrench recited in claim 9 wherein said means for fixing said cap comprises a cylindrical stem on said shank, a central bore in said cylindrical stem, a radial hole in said cylindrical stem, a positioning button in said central bore, a shallow recess and a deep recess in said button, a spring engaging said button, urging said button outwardly, said cap having a central bore receiving said cylindrical stem, two circumferentially spaced grooves in said cap in the surface defining said central bore of the cap, a positioning ball in said radial hole, said ball being movable out of said grooves in said cap and into said deep recess in said button when said button is in a first position, said ball being movable into one or the other of said grooves in said cap and into said shallow recess in said button when said button is in a second position, said cap being engaged with said first end of said ring-shaped spring when said ball is in one of said grooves of the cap and engaged with said second end of said ring-shaped spring when said ball is in the other of said grooves of the cap.

11. The wrench recited in claim 9 wherein said means for fixing said cap comprises a cylindrical stem on said shank, a central bore in said cylindrical stem, a radial hole in said cylindrical stem, a positioning button in said central bore, a shallow recess and a deep recess in said button, a spring engaging said button urging said button outwardly, said cap having a central bore receiving said cylindrical stem, four circumferentially spaced grooves in said cap in the surface defining said central bore of the cap, two balls in said radial hole, said balls being movable out of said grooves in said cap and into said deep recess in said button when said button is in a first position, said balls being movable into two of the said grooves in said cap and into said shallow recess in said button when said button is in a second position, thus fixing said cap relative to said cylindrical stem of said shank, said cap being engaged with said first end of said ring-shaped spring when said balls are in two of said grooves of the cap and engaged with said second end of said ring-shaped spring when said balls are in the other two of said grooves of the cap.

* * * * *